US005314525A

United States Patent [19]

Eckert et al.

[11] Patent Number: 5,314,525

[45] Date of Patent: May 24, 1994

[54] METHOD FOR TREATING A LIQUID WITH A GAS USING AN IMPELLER

[76] Inventors: Charles E. Eckert, 260 Lynn Ann Dr., New Kensington, Pa. 15068; Nicholas G. Walker, 692 Mimosa Tree La., West Chester, Pa. 19380

[21] Appl. No.: 950,412

[22] Filed: Sep. 23, 1992

Related U.S. Application Data

[62] Division of Ser. No. 766,624, Sep. 26, 1991, Pat. No. 5,160,693.

[51] Int. Cl.[5] ..... C22B 21/06

[52] U.S. Cl. ..... 75/583; 75/528; 75/708; 266/235; 420/590

[58] Field of Search ..... 75/583, 235, 708; 266/235; 420/590

[56] References Cited

U.S. PATENT DOCUMENTS

| | | | |
|---|---|---|---|
| 3,871,872 | 3/1975 | Downing | 266/235 |
| 4,203,581 | 5/1980 | Petlon | 266/235 |
| 4,426,068 | 1/1984 | Gimond | 266/235 |
| 4,470,846 | 9/1984 | Dubé75 | 68 R/ |
| 4,538,959 | 9/1985 | Cantor et al. | 415/98 |
| 4,634,105 | 1/1987 | Withers et al. | 266/217 |
| 4,670,050 | 6/1987 | Ootsuka et al. | 75/68 R |
| 4,743,428 | 5/1988 | McRae et al. | 420/590 |
| 4,802,656 | 2/1989 | Hudault et al. | 266/225 |
| 4,908,060 | 3/1990 | Duenkelmann | 75/61 |
| 4,931,091 | 6/1990 | Waite et al. | 266/212 |
| 5,158,737 | 10/1992 | Stern | 266/235 |

FOREIGN PATENT DOCUMENTS 0419378 3/1991 European Pat. Off. .

*Primary Examiner*—Peter D. Rosenberg

*Attorney, Agent, or Firm*—Dann, Dorfman, Herrell and Skillman

[57] ABSTRACT

An improved impeller head is provided for treating molten metals and other liquid systems with a gas. A multiple-vaned impeller head is adapted for mounting on a hollow impeller shaft for rotation within the liquid The edges of the impeller vanes are extended by an axial groove which intercepts the hub and the vanes of the impeller head. Extension of the trailing edge of the vanes creates greater turbulence in the liquid as the impeller is rotated in the liquid and increases the impeller's efficiency. The impeller vanes may also have canted leading surfaces which create an upward axial flow of liquid to discourage formation of a surface vortex. Multiple impellers may also be mounted on a shaft in the vessel and the gas may be introduced remotely.

38 Claims, 8 Drawing Sheets

METHOD FOR TREATING A LIQUID WITH A GAS USING AN IMPELLER

This is a division, of co-pending application Ser. No. 07/766,624, filed Sep. 26, 1991 now U.S. Pat. No. 5,160,693.

FIELD OF THE INVENTION

The present invention relates to an improved rotary impeller head for treating molten metal such as aluminum to remove gas and solid impurities.

BACKGROUND OF THE INVENTION

Molten metals, such as aluminum, typically contain both dissolved and suspended impurities. Suspended impurities include, for example, the simple and complex oxides, nitrides, carbides, and carbonates of the various elements that constitute the alloy. Dissolved impurities include both dissolved gases and dissolved solids. For example, nitrogen, oxygen, and hydrogen have a high liquid phase solubility in iron. Oxygen is highly soluble in copper and silver. Hydrogen is appreciably soluble in aluminum. Dissolved solid impurities include, for example, sulfur and phosphorous in iron, and alkali elements, such as sodium or calcium, in aluminum.

Fluxing is a general category of processes used to remove both dissolved and suspended impurities by the combination of physical desorption, chemical reaction mechanisms, and floatation of suspended solids. Gas sparging is a commonly employed fluxing process wherein an inert or inert/reactive gas combination is introduced into the melt as efficiently as possible to mix and react with the melt thereby removing impurities. For example, it is well known to disperse chlorine or a reactive chloride gas into a molten metal to form the chloride salt of the metal impurity. The salt rises to the surface of the melt and is thereafter removed. It is also well known, for example, to use fluorocarbons, such as dichlorodifluoromethane, to treat molten aluminum with a reactive gas to reduce the amounts of gas impurities and oxides, along with impurities such as sodium and calcium. Suspended solids are transported to the melt surface by attachment to rising gas bubbles.

One specific use to which gas sparging is useful is purification of molten aluminum. Gas sparging is optimized by dispersing extremely small gas bubbles throughout the molten aluminum or melt. Hydrogen, for example, is removed from the melt by desorption into the gas bubbles, while other alkali elements react with the sparging gas and are lifted into a dross layer by flotation. Dispersion of the sparging gas into the melt is facilitated by a rotating gas distributor, or phase contactor, which simultaneously produces a high degree of turbulence in the melt. Turbulence assures thorough mixing of the sparging gas with the melt which, in moderately turbulent environments, are removed to the melt surface by peripheral interception and equatorial contact, i.e. the particles agglomerate, attach to the gas bubbles, and float to the surface. Impurities removed from the melt by peripheral interception are withdrawn from the system with the dross while hydrogen desorbed from the molten metal leaves the system with the sparging gas.

The process efficiency of a particular phase contactor is related to its ability to maximize liquid and gas interphase interfacial area and to effectively disperse the gas phase throughout the melt volume. Liquid diffusion transport distance refers to the range of hydrogen ion migration in a stagnant melt over a concentration gradient between two stationary points. This quantity is used to estimate liquid phase transport resistance of hydrogen in a particular solution, from a remote site in the melt to a gas bubble in the absence of fluid convection or bulk flow transport. Effective dispersion of the gas heat minimizes liquid diffusion transport distance of cations by the development of a flow field. Additionally, flotation efficiency for removing suspended impurities is inversely proportional to the square of the bubble diameter. Therefore, producing the greatest number of small, dispersed gas bubbles maximizes the physical desorption, chemical reaction, and floatation efficiency.

It is known in the prior art to provide a phase contactor consisting of an impeller fixed to the end of a rotating shaft. The impeller comprises a hub with solid radial vanes projecting from the hub. As the impeller rotates through the melt, a vortex street, i.e. a series of vortices that trail behind an object, is produced at the trailing surfaces of the vanes to generate shear. Using such an impeller, a stream of sparging gas is introduced into the melt as the impeller rotates deep within the melt. Gas buoyancy and the low pressure region created behind the vanes combine to cause the melt and gas to mix. The sparging gas interacts with the vortex street created by each vane and is ejected as small gas bubbles.

The shear field created by the impeller vanes comprises numerous eddies that interact with the subsurface stream of sparging gas to generate small bubbles of gas. Energy to create new surface area is supplied by these eddies. The rotating impeller also imparts radial fluid flow that disperses the bubbles throughout the melt volume. Continuity in an incompressible medium, such as molten metal, results in the unfortunate consequence of an axial flow component to the flow field. As a result, a surface vortex forms, rotating about and flowing downwardly along the impeller shaft, agitating the surface dross and drawing impurities back into the melt.

The most effective rotating impeller phase contactor will operate at high shear, and also promote radial flow. Ideally the phase contactor should also minimize disturbance to the surface dross to prevent recontamination to the gas-treated melt.

It is therefore an object of the present invention to provide an improved rotating impeller head phase contactor which maximizes liquid and gas interphase interfacial area to effectively disperse the sparging gas throughout the melt volume.

It is a further object of the present invention to provide an improved rotating impeller head phase contactor which imparts power to the melt for the purpose of thoroughly mixing the liquid phase with the gaseous phase.

It is also an object of the present invention to provide an improved apparatus including a rotating impeller head phase contactor which creates sufficient turbulence but which minimizes formation of a vortex at the top of the melt around the impeller shaft which would disrupt the dross layer and draw surface impurities down into and recontaminate the melt.

SUMMARY OF THE INVENTION

The present invention provides an improved rotating impeller head for treating molten metals such as aluminum, magnesium, copper, and the like. The impeller is designed to receive a hollow rotating impeller shaft through which a sparging or fluxing gas is injected into the molten metal in a stir tank or crucible to remove impurities. The impeller effectively creates increased turbulence of the molten metal to finely disperse the sparging gas within the melt to maximize the sparging process efficiency.

The impeller has a central hub with an axial bore equal to the thickness of the hub. The bore is threaded and designed to receive an impeller shaft having a threaded end surface and a gas flow outlet opening. Purging gas flows from an external source through the shaft and impeller, and exits at the underside of the impeller relative to the surface of the melt. The hub has a predetermined number of vanes fixed to and extending radially from the hub to create turbulence in the molten metal in the stir tank or crucible as the impeller rotates. The hub has at least one radial groove disposed in one end surface of the hub which intersects and effectively extends the leading and trailing surface edges of each vane. Extension of the leading and trailing surface edges increases turbulence in the melt which increases the impeller's efficiency.

In an alternate embodiment, the vanes have angled leading surfaces to cause an upward flow of molten metal along the impeller shaft. This upward flow counteracts the downward flow of molten metal due to formation of a surface vortex around the rotor shaft. This reduces the likelihood of agitation of the dross layer and recontamination of the melt resulting from the downward flow of impurities floated out of the melt.

In another embodiment of the present invention, the stir tank or crucible has a baffle fixed to the tank wall or otherwise positioned in the vessel, and projecting toward the impeller. The baffle interrupts the swirling movement of the molten metal and thereby reduces the likelihood of a vortex forming on the melt surface around the shaft. The baffle is positioned sufficiently below the dross so that the dross is not disrupted up by the baffle.

In another embodiment, a selected number of additional impeller heads are intermittently spaced a predetermined distance from each other on a common impeller shaft. The stacked impeller heads may be different sizes and have different groove dimensions. The impeller heads need not be evenly spaced on the shaft.

In a further embodiment, a separate gas injection device remote from the impeller is positioned in the vessel tank, preferably below the impeller. The gas injector may be in the form of a diffuser or nozzle which augments the impeller by finely dispersing the gas into small bubbles.

DETAILED DESCRIPTION OF THE PREFERRED EMBODIMENT

While the present invention has application in refining a wide variety of molten metals such as, for example, steel, magnesium, copper, zinc, tin, lead, iron and their alloys, nickel has super alloys, cobalt base super alloys and other fluid systems, it is particularly useful in, and will be hereinafter described in reference to, purifying molten aluminum. The present invention is also useful for treating other fluids such as water to facilitate a carbonation process.

Figure 1:
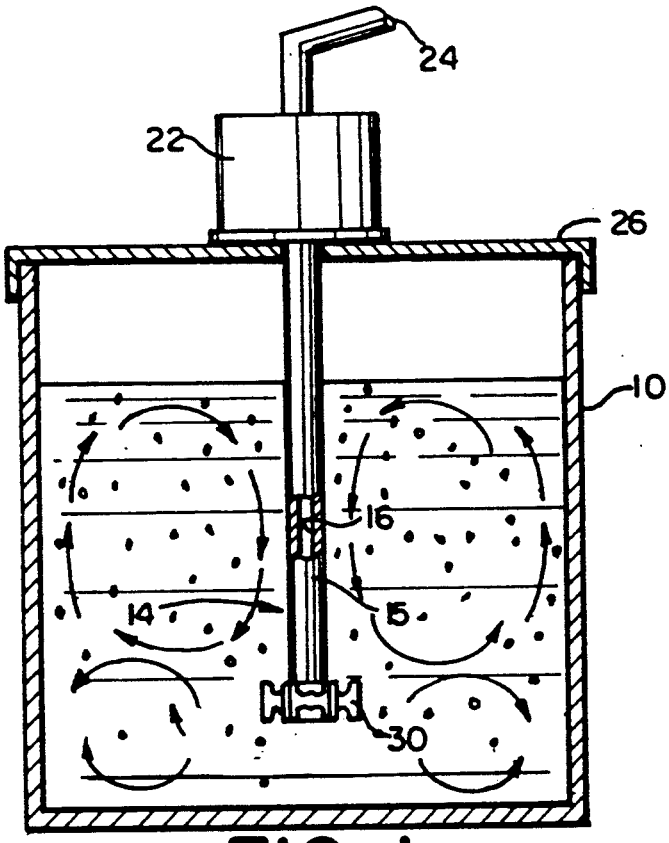
FIG. 1 is a diagrammatic view showing a conventional stir tank or crucible using a rotating impeller for treating molten metal in accordance with the present invention.

Referring to FIG. 1, molten aluminum 12 is deposited in a crucible or stir tank 10 having a lid 26 which covers the open end of the tank. An impeller 14 is mounted to the stir tank 10 at one end and is submerged deeply in the melt 12 at the other end. The impeller 14 comprises an impeller head 30 with a central, axial bore 34 sized to receive one end of a rotating impeller shaft 15. The other end of the impeller shaft is fixed to a rotator or motor 22 which rotates the impeller within the melt. The impeller shaft 15 has an internal, axial bore 16 which serves as a passage for sparging gas from an external supply source 24 through the impeller shaft 15 and head 30, and into the melt 12. As the impeller rotates, sparging gas simultaneously flows into and is mixed with the melt. Hydrogen is desorbed into the gas bubbles while other alkali elements may chemically react with the sparging gas and be removed by floatation of the reaction products to the dross layer thereby purging the metal of impurities. Further, suspended impurities, such as oxides, are transported by the gas bubbles to the melt surface by flotation.

Figure 2:
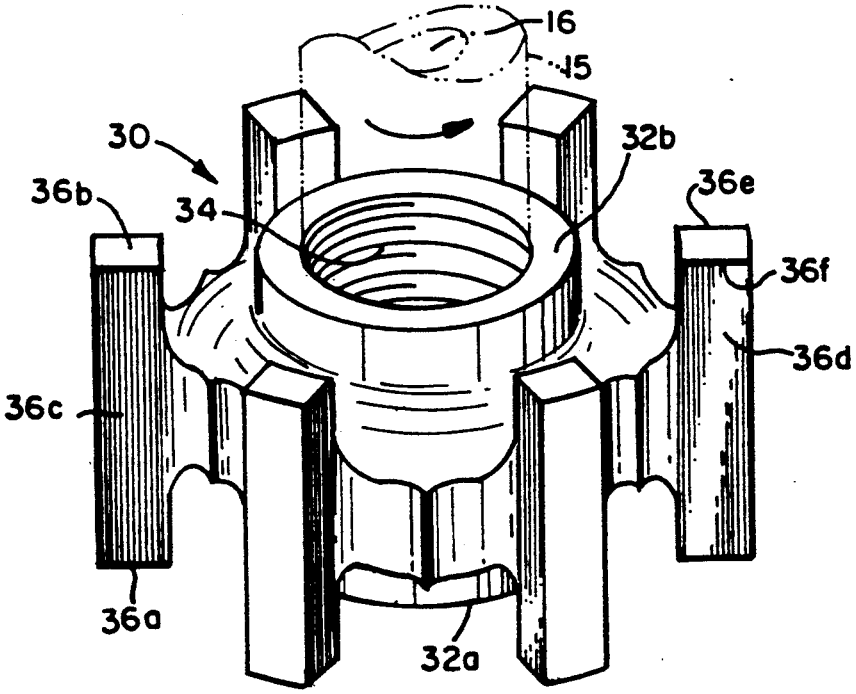
FIG. 2 is a perspective view of an impeller head according to one embodiment of the present invention attached to a hollow impeller shaft.
Figure 4:
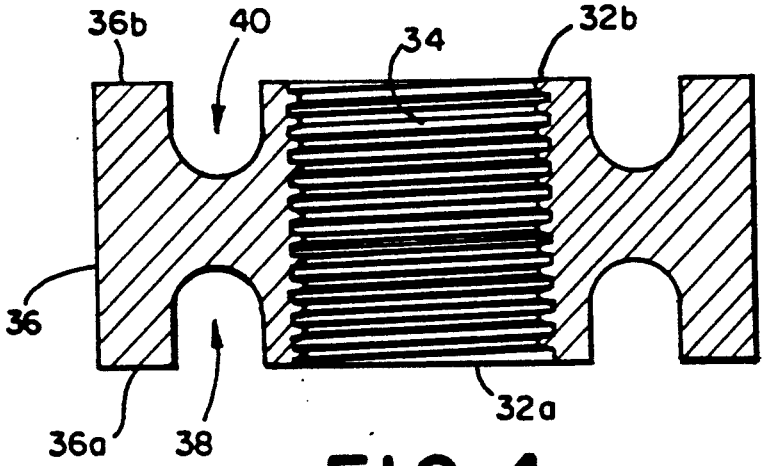
FIG. 4 is a cross-sectional view taken along line 4—4 of FIG. 3.
Figure 7:
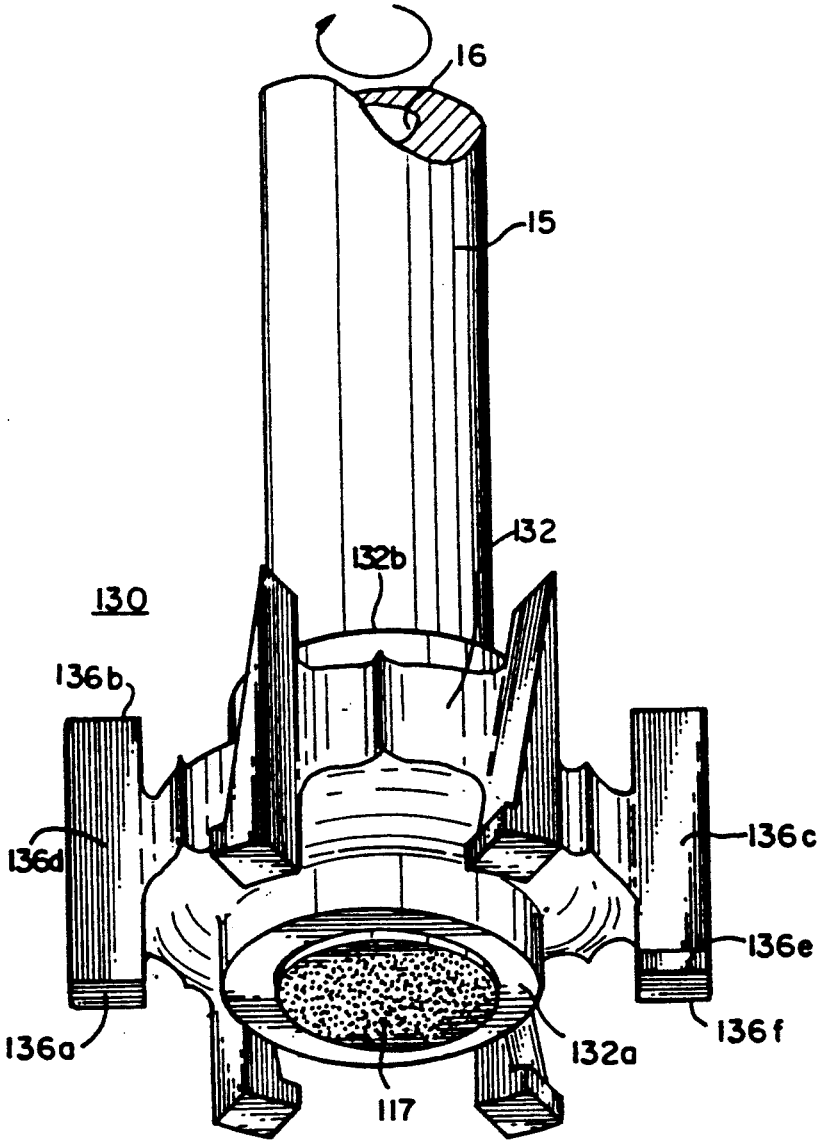
FIG. 7 is a fragmentary, bottom perspective view of an impeller according to a second embodiment of the present invention having vanes with canted leading surfaces.
Figure 10:
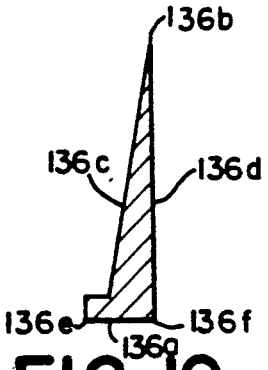
FIG. 10 is a cross-sectional view taken along line 10—10 of FIG. 8 showing the profile of a vane having a canted leading surface.
Figure 8:
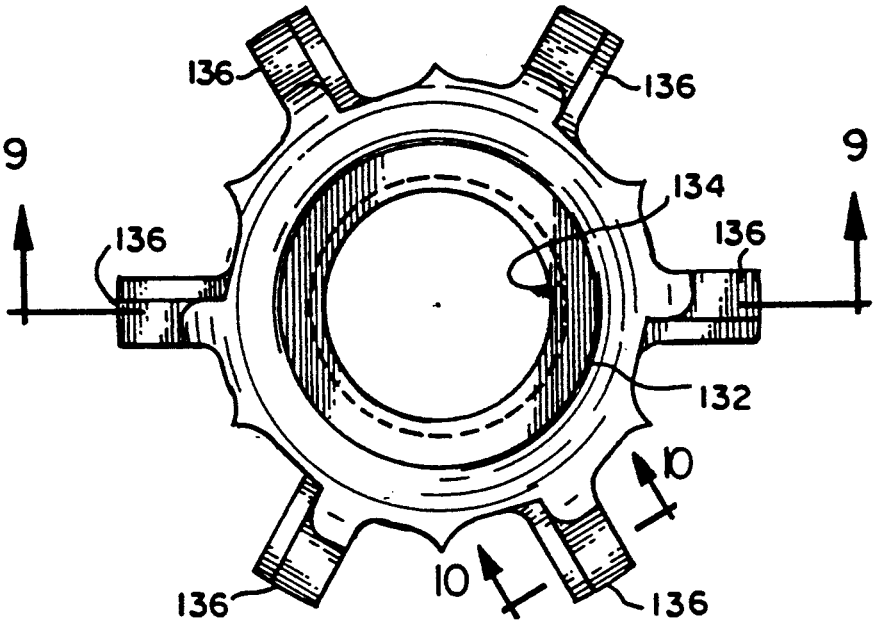
FIG. 8 is a top plan view of the impeller head shown in FIG. 7.
Figure 9:
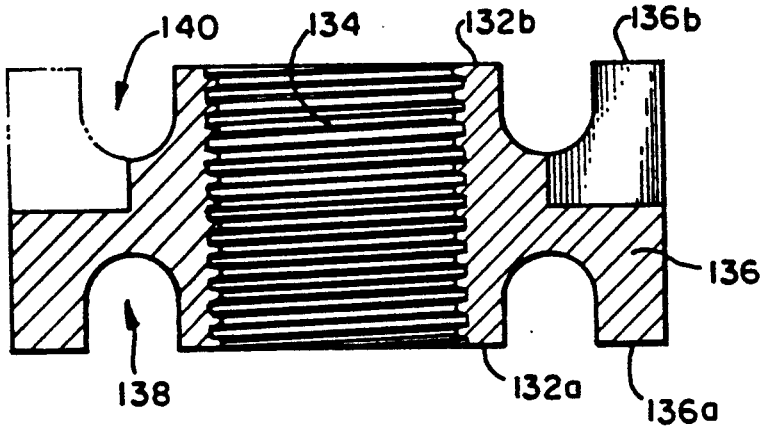
FIG. 9 is a cross-sectional view taken along line 9—9 of FIG. 8.

Referring to FIG. 2, the impeller head has a hub 32 with a central, axial bore 34. The impeller head may be made of any easily fabricated material that is resistant to molten aluminum, and that is resistant to the halide gases and fluxes that might be used to purge the melt. The preferred material is graphite. The bore 34 has a diameter slightly larger than the outer diameter of the shaft to receive the impeller shaft 15 and is preferably threaded, as seen in FIG. 4, to receive the shaft 15, also having a threaded end. The shaft 15 has a gas flow outlet opening at the threaded end for discharging purging gas into the melt 12. The gas flow outlet may have a permeable diffuser 117 as seen in FIG. 7 to more effectively disperse the gas in the melt. The permeable diffuser augments the impeller by finely dispersing the gas as the gas flows through the diffuser 117. Preferably, the permeable diffuser would have a permeability range of 50 to 2000 centi-D'Arcys. Alternatively, other types of diffusers or nozzles may be mounted to the impeller head to increase dispersion of the gas into the melt.

Figure 3:
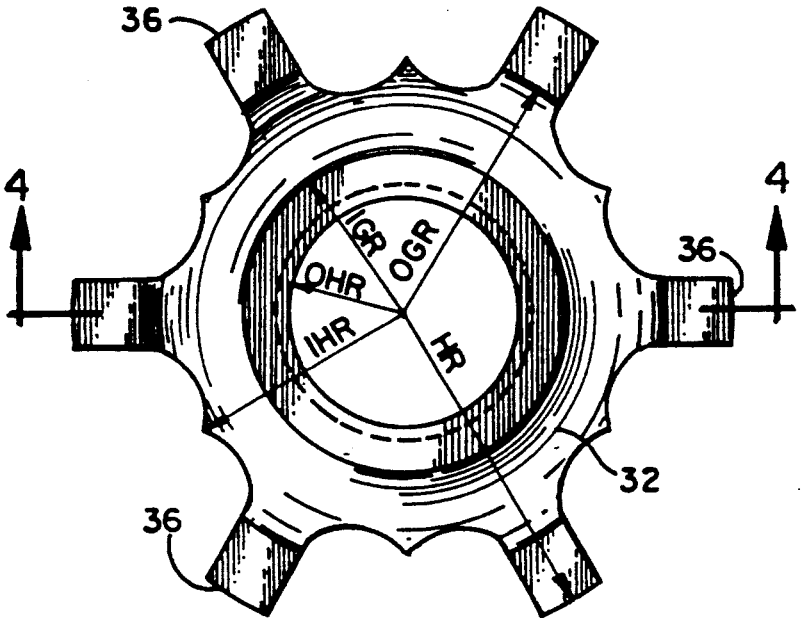
FIG. 3 is a top plan view of the impeller head shown in FIG. 2.

The hub 32 has a lower or first end surface 32*a* and an opposed upper or second end surface 32*b*, distal and proximal to the surface of the melt 12, respectively. The first 32*a* and second 32*b* end surfaces define the thickness of the hub therebetween. The radii of the end surfaces 32*a* and 32*b* are substantially equal. As seen in FIGS. 3 and 4, the outer radius of the hub is not uniform along the central axis or around the circumference of the hub.

A predetermined number of vanes 36 are fixed to and extend radially beyond the hub 32. The vanes create turbulence for enhancing liquid and gas interphase interaction and impart radial flow for enhancing dispersion into the melt. The vanes are spaced at generally equal distances about the perimeter of the hub 32. In a preferred embodiment illustrated in FIG. 2, each vane 36 has generally parallel faces defining a uniform cross-section along the length of the vane. The end surfaces of each vane 36*a* and 36*b* define the length of the vane located therebetween. The vanes have a leading surface 36*c* and a trailing surface 36*d* relative to the direction of rotation as shown in FIG. 2. The leading 36*c* and trailing 36*d* surfaces are generally rectangular and have a length equal to the vane length and a width equal to the radial extent of the vane end surfaces 36*a* and 36*b*. The boundaries between the leading and trailing surfaces, and the vane end surfaces define leading 36*e* and trailing 36*f* edges, respectively.

Figure 5:
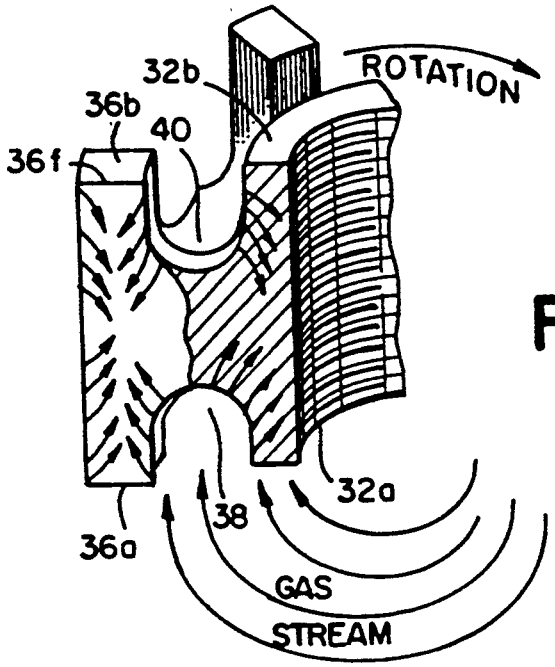
FIG. 5 is an enlarged, fragmentary view of the impeller shown in FIG. 2 showing one vane.

The number of vanes and the spacing between the vanes is an important design consideration. As illustrated by the fluid flow lines in FIG. 5, a vortex street forms behind each vane beginning at the trailing edge 36*f*. If the vanes are positioned too close to one another, shrouding of one vane by a leading vane, relative to the direction of rotation, occurs and decreases efficiency. If the vanes are positioned too far apart, the vortex street decays between vanes which also decreases efficiency.

The number of vanes is also dependent on the size and geometry of the stir tank 10 and may range from 2 to 12 and preferably four to eight. Generally it is preferred to use a greater number of vanes in an unbaffled tank or a tank with a regular shape. It has been experimentally determined that the power input provided by the impeller is generally inversely proportional to the number of vanes. Excessive rotational flow, leading to a surface vortex, can be caused by too few vanes in an unbaffled or highly symmetrical tank. For example, based on carbon dioxide desorption kinetic experiments, a seven-inch diameter impeller optimally should have twelve vanes and should operate at an optimal rotational speed of approximately 375 RPM without the use of a baffle in a circular cross-sectional tank.

The hub 32 has an axial groove 38 in the lower or first end surface 32*a* of the hub as seen in FIGS. 2 and 4. Referring to FIG. 3, the groove 38 has an inner groove radius, IGR, greater than the inner hub radius, IHR, and an outer groove radius, OGR, greater than or equal to the outer hub radius, OHR. Preferably the outer groove radius, OGR, is slightly larger than the outer hub radius, OHR, thereby maximizing the leading and trailing surfaces of the vanes. The groove 38 intercepts the leading 36*e* and trailing 36*f* surfaces edges of the vanes 36 to increase the form drag of each vane. As illustrated by the fluid flow lines in FIG. 5, the leading and trailing edges are effectively extended by the groove which increases turbulence as the impeller 14 rotates through the melt. The leading and trailing surfaces act as rotating oblique objects to promote vortex streaming. Additionally, the groove increases the greater pressure drop across the vane to further enhance gas stream involvement with the vortex street. The result is increased local fluid turbulence, greater mechanical power adsorption, and smaller bubbles. The groove 38 also enhances radial flow to eject the bubbles into the melt 12.

The depth of the groove 38 is approximately equal to one-third the thickness of the hub. Preferably the width of the groove 38 is approximately equal to the groove depth. The relative position of the groove on the hub is important. As shown in FIG. 3, the outboard radial dimension, ORD, of the vanes, defined by the distance from the outer groove radius, OGR, to the outer extremity of the vane, preferably should be greater than or equal to the groove width.

Referring to FIGS. 2 and 4, the impeller preferably also has a second groove 40 in the upper or second end surface 32*b* of the hub. The second groove 40 serves the same function as the first groove i.e. creating greater turbulence and radial flow for enhancing process efficiency. Referring to FIG. 3, the second groove 40 has an inner groove radius, IGR, greater than the inner hub radius, IHR, and an outer groove radius, OGR, greater than or equal to the outer hub radius, OHR. Preferably the outer groove radius, OGR, is slightly larger than the outer hub radius, OHR, thereby maximizing the leading and trailing surfaces of the vanes. The impeller radius is equal to the outer groove radius, OGR, plus the radial outboard dimension.

It is not necessary that the first 38 and second 40 grooves be identical in size or relative position. The size, shape, or relative position of the second groove 40 may be dependent on other factors such as the size and symmetry of cross-section of the stir tank 10, number of vanes 36, or dimensions of the hub 32.

In operation, the impeller rotates at a predetermined speed through the melt to optimize the process efficiency. As illustrated by the flow lines in FIG. 5, the sparging gas is discharged into the melt from the lower side of the impeller head and propelled outwardly into the radial flow field created by the vanes. As rotational speed of the impeller increases, a vortex has a tendency to form on the melt surface around the impeller shaft. The vortex may disturb the dross layer and has a tendency to draw the dross back down into the melt and recontaminate the melt. It is recognized and encompassed within the scope of the present invention to provide a submerged baffle 50 positioned in the stir tank 10 to increase the radial velocity gradient, i.e. radial flow of the liquid phase, which thereby increases shear. The baffle 50 is shown fixed to the stir tank wall 10 in FIG. 6 but may be positioned in the vessel by mounting to the lid 26 or other means. The baffle also discourages formation of a surface vortex.

Figure 6:
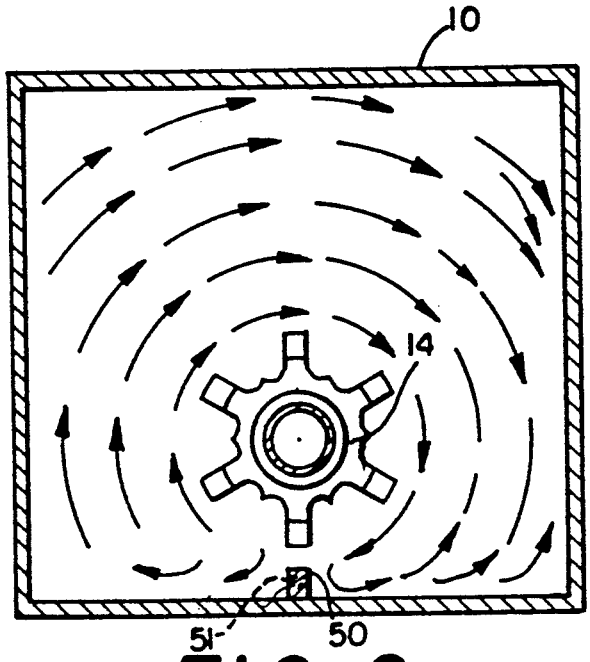
FIG. 6 is a top diagrammatic view of a rotating impeller in a stir tank having a fixed baffle illustrating the flow currents of the molten metal.

As illustrated by the fluid flow lines in FIG. 6, the baffle retards formation of a vortex. The baffle 50 is positioned below the dross, preferably about three inches below the surface. The baffle should extend from the stir tank wall into close proximity to the impeller, preferably within 0.15 to 2.5 impeller diameters, and preferably within 0.2 to 1.5 impeller diameters from the impeller. Perforations 51 in the baffle near the stir tank wall are preferably included to minimize the stagnant volume of molten aluminum not interacting with the sparging gas, or bulk fluid movement.

The impeller may be operated at an increased speed with use of a baffle in the tank. For example, based on carbon dioxide desorption kinetic experiments, a seven inch impeller with twelve vanes is optimally operated at 375 RPM's. However, with a radial baffle in the stir tank, a six vane impeller may be used and rotated at 425 RPM. The baffle further enhances bulk shear by increasing the radial bulk velocity gradient around the impeller. Gas bubble transport to the perimeter of the stir tank is also improved because density separation (centrifugation) is minimized. Formation of a surface vortex at high impeller power input is virtually eliminated using the baffle. Formation of a surface vortex is also inhibited by use of an irregular shaped tank or by positioning the impeller asymmetrically within the tank as shown in FIG. 6.

Another embodiment of the present invention embodies an impeller having canted leading vane surfaces is illustrated in FIGS. 7–10. An impeller head according to this embodiment is generally similar to the first embodiment except for the canted leading surface 136*c* which is oblique relative to the trailing surface 136*d* and the end surfaces 136*a* and 136*b*. The hub 132 may have one or two axial grooves for enhancing turbulence and dispersing the gas phase throughout the melt.

As illustrated in FIG. 1, use of a rotating impeller having vanes with blunt leading surfaces not only has a tendency to create a surface vortex, but also creates a downward axial flow of molten metal around the impeller shaft due to the incompressibility of the melt. To counteract downward flow, the canted leading surfaces 136 of the vanes promote an upward axial flow which discourages the dross from being drawn back down into the melt.

The leading surface 136*c* of each vane may be canted approximately 3–45 degrees, preferably between 10 to 35 degrees, and most preferably between 20 to 25 degrees. The angle of inclination of the leading surface can be changed to accommodate different vane dimensions, different metals, and other fluids having a broad range of kinematic properties. A forwardly projecting axial shroud is provided at the leading edge 136*e* to enhance the suppression of downward flow along the leading surface 136*c*.

Figure 11:
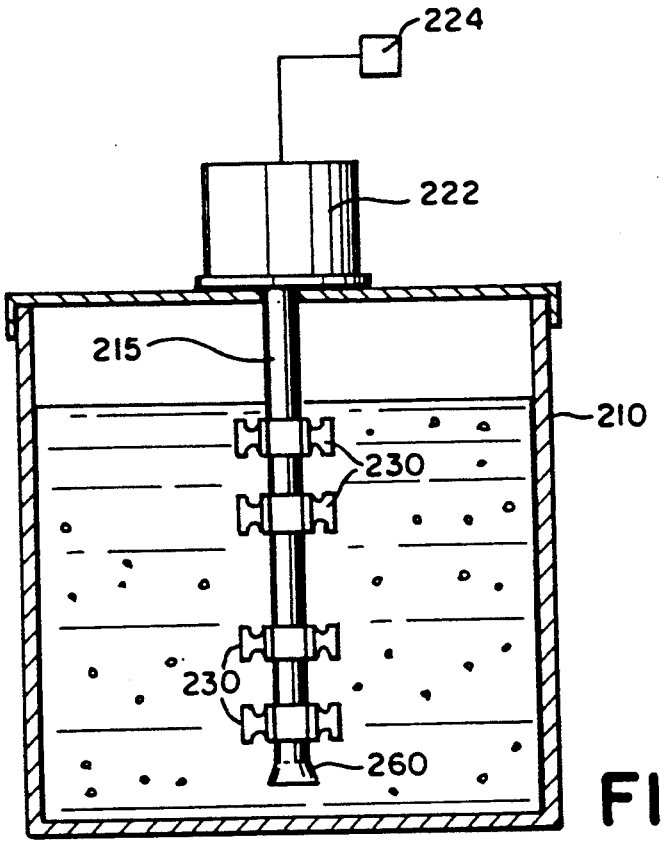
FIG. 11 is a diagrammatic view of another embodiment of the present invention having multiple impeller heads mounted on a single impeller shaft.

In another embodiment of the present invention shown in FIG. 11, a predetermined number of impeller heads 230 are affixed to a single impeller shaft 215. The impeller head fixed to the free end of the shaft may have a diffuser or nozzle 260 mounted at the gas flow outlet opening or at a remote site in the vessel below the impeller head. The impeller heads 230 need not have similar radial or groove dimensions or configurations. The impeller heads are spaced at a predetermined separation distance on the shaft, preferably 0.5 to 2.0 times the impeller diameter. The impeller heads need not be equally spaced along the length of the shaft. This embodiment having multiple impeller heads 230 further increases power input, further modifies the fluid flow field to increase shear, and controls formation of a surface vortex.

Figure 12:
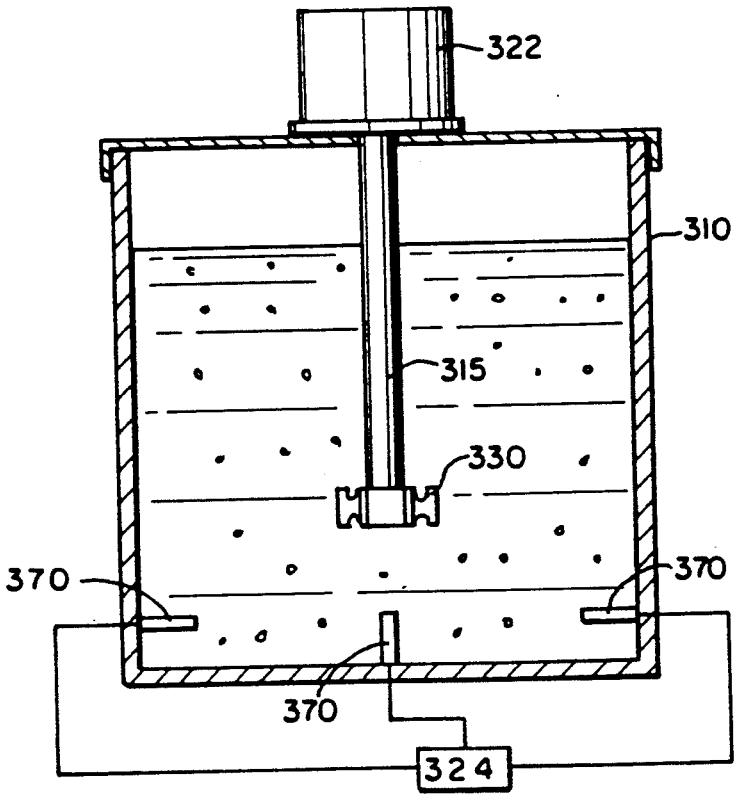
FIG. 12 is a diagrammatic view of another embodiment of the present invention illustrating a remote gas injector.

In a further embodiment of the present invention shown in FIG. 12, the purging gas is introduced into the melt by a remote gas-injection device 370, such as a supersonic or subsonic nozzle or diffuser. The gas injector preferably is positioned below the impeller 330 relative to the surface dross layer. Several gas injectors 370 may be provided to increase the gas sparging rate capability. Remote gas injectors 370 may be used with any of the aforementioned impeller heads or with multiple impeller heads stacked uniformly or at different spacing on a common drive shaft.

In this embodiment the impeller functions more as a mixing and dispersing device than as a device for creating shear because the gas injectors finely disperse gas bubbles into the melt. This embodiment accommodates gas injectors which are not easily adaptable to the impeller head 330 or shaft 315 such as supersonic nozzles or diffusers with diffuser areas larger than the impeller head.

While particular embodiments of the present invention have been herein illustrated and described with reference to treating molten metals, it is appreciated that an impeller head as described above has universal applications in finely dispersing a gaseous phase throughout a liquid phase. For example, an impeller as described herein would have practical application in aqueous systems for carbonation of liquids, aeration of aerobic bacteria, or installation in a sewage treatment clarifier for enhanced flotation.

The improved efficiency of the present invention is illustrated by the following examples:

EXAMPLE 1

A rectangular stir tank containing approximately 100 gallons of water was prepared. The impeller drive motor and associated hardware was then positioned over this tank, with the drive shaft centerline located at a position of one third of the longitudinal dimension from the front wall. All impellers were submerged to a depth of 22 inches. A seven-inch diameter, eight vane impeller according to the first embodiment of the present invention (hereinafter "ET" impeller) was used for comparison.

Carbon dioxide was dissolved in the water to an initial concentration of 450 ppm, for all experiments. A series of commercially available impellers, and an impeller according to the present invention, were subsequently operated over a range of operating parameters. Water temperature was adjusted to within a range of 25° C. to 27° C. in all cases.

Samples of water were extracted from the stir tank at precise 2 and 3 minute intervals and analyzed, real time, for carbon dioxide. An Orion carbon dioxide ion selective electrode was standardized with sodium bicarbonate solutions, and was used for the analysis. The carbon dioxide concentration range of 50 to 450 ppm was examined.

An integral-batch method of analysis was used to evaluate the data. In this case, the following first order exponential decay equation applies:

$$\underline{C}=C_o(1-e^{-kt})$$

Where:

C=Carbon dioxide concentration $\overline{C}_o$=Initial concentration k=A lumped parameter rate constant (measured)

t=time

A semi-log plot of concentration ratio verses time was prepared to identify the linear (transport controlled) domain. Data was subsequently selected from this domain, and the value of the rate constant, k, determined by regression analysis of the data set.

It is desirable to determine the theoretical value of the rate constant for a given sparging rate, under equilibrium conditions. Since this situation represents no transport resistance, it becomes a limited condition for the experiments. The derived expression for the equilibrium rate constant is:

$$k_E = 6.73 \times 10^2 \frac{Q_g \rho_g}{M_T}$$

Where:

$Q_g$=The gas sparging rate in SCFJ.
$\rho_g$=Sparging gas density, lb/ft$^3$
$M_T$=Mass of water in the stir tank, lb The value of the coefficient, $6.73 \times 10^2$, was determined by the Henry's law constant for carbon dioxide in water, and is dimensionally consistent with the other variables as specified.

Figure 13:
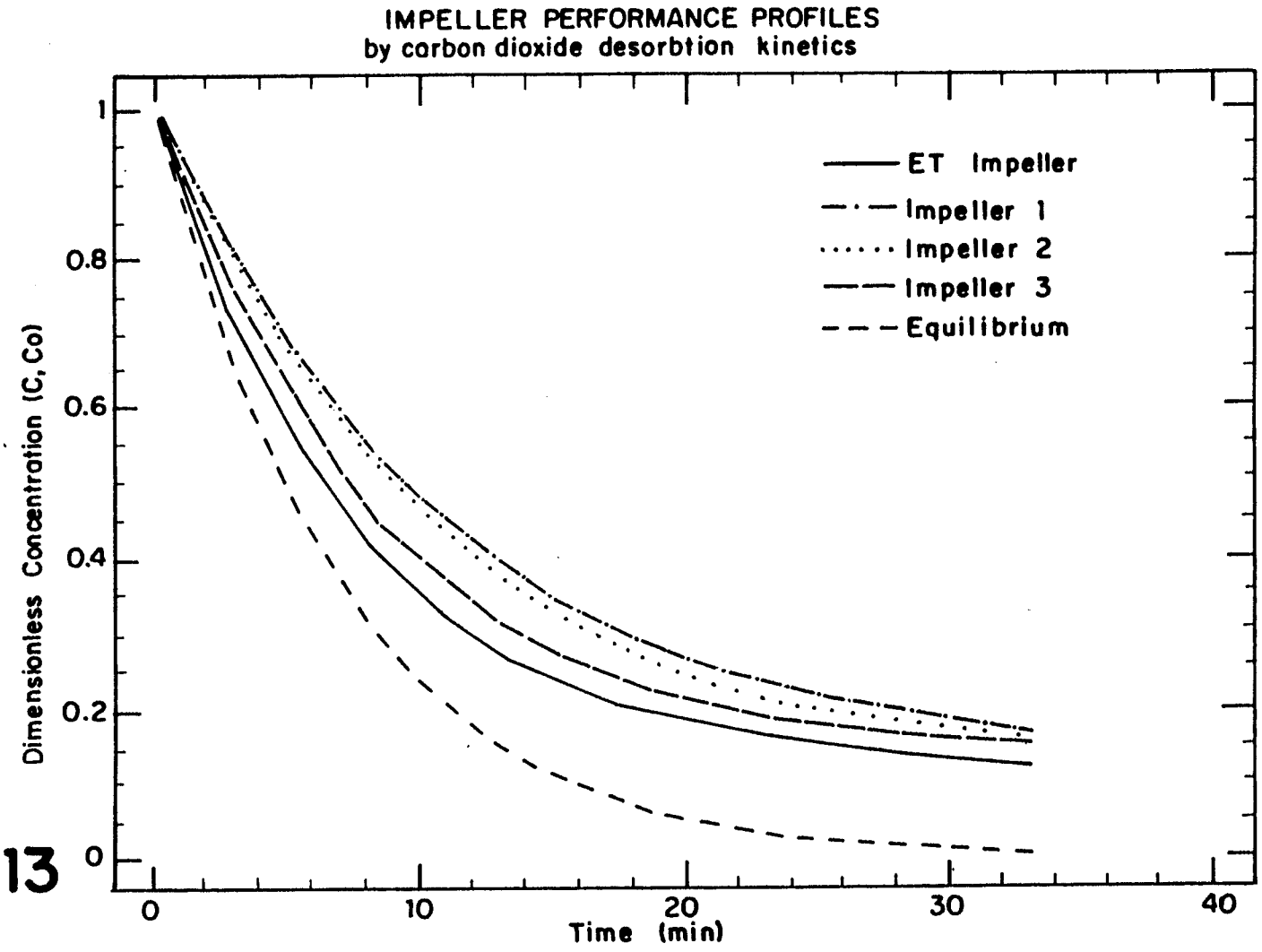
FIG. 13 is a graphical illustration of a comparison of impeller performance profiles.

A graphical representation of data collected for the ET impeller and 3 commercially available impellers is depicted in FIG. 13. In all cases, a sparging rate of 90 SCFH argon was used. The performance under equilibrium conditions is also included for comparison. Table 1 tabulates the time required to achieve $C=0.2\ C/C_o$ for the four cases investigated in this example.

TABLE 1

| Impeller | t, ($C = 0.2\ C/C_o$), min |
|---|---|
| 1 | 29.1 |
| 2 | 25.0 |
| 3 | 22.0 |
| "ET" | 18.5 |
| Equilibrium | 11.3 |

The performance of this embodiment of the present invention clearly operates closer to equilibrium than the other impellers that were evaluated.

EXAMPLE 2

Impeller input power can be used as a measurement of the mixing capability of a particular stir tank system. In this example, input power was measured by recording the voltage and current requirements of a direct current drive motor, for four stir tank systems. Digital filtering was used to supply time-smoothed values for voltage and current. Further, power input for a particular stir tank system was corrected for parasitic mechanical losses of the impeller drive mechanism. All stir tank parameters and gas sparging rates used were the same as in Example 1.

A commercially available impeller was examined, along with a 7-inch diameter, 6 vaned "ET" impeller according to the first embodiment of the present invention. Both impellers were operated with and without a single submerged baffle, of a projection length of 1.5 times the impeller diameter, positioned at a distance of 1 impeller diameter from the circumference of the impeller.

Figure 14:
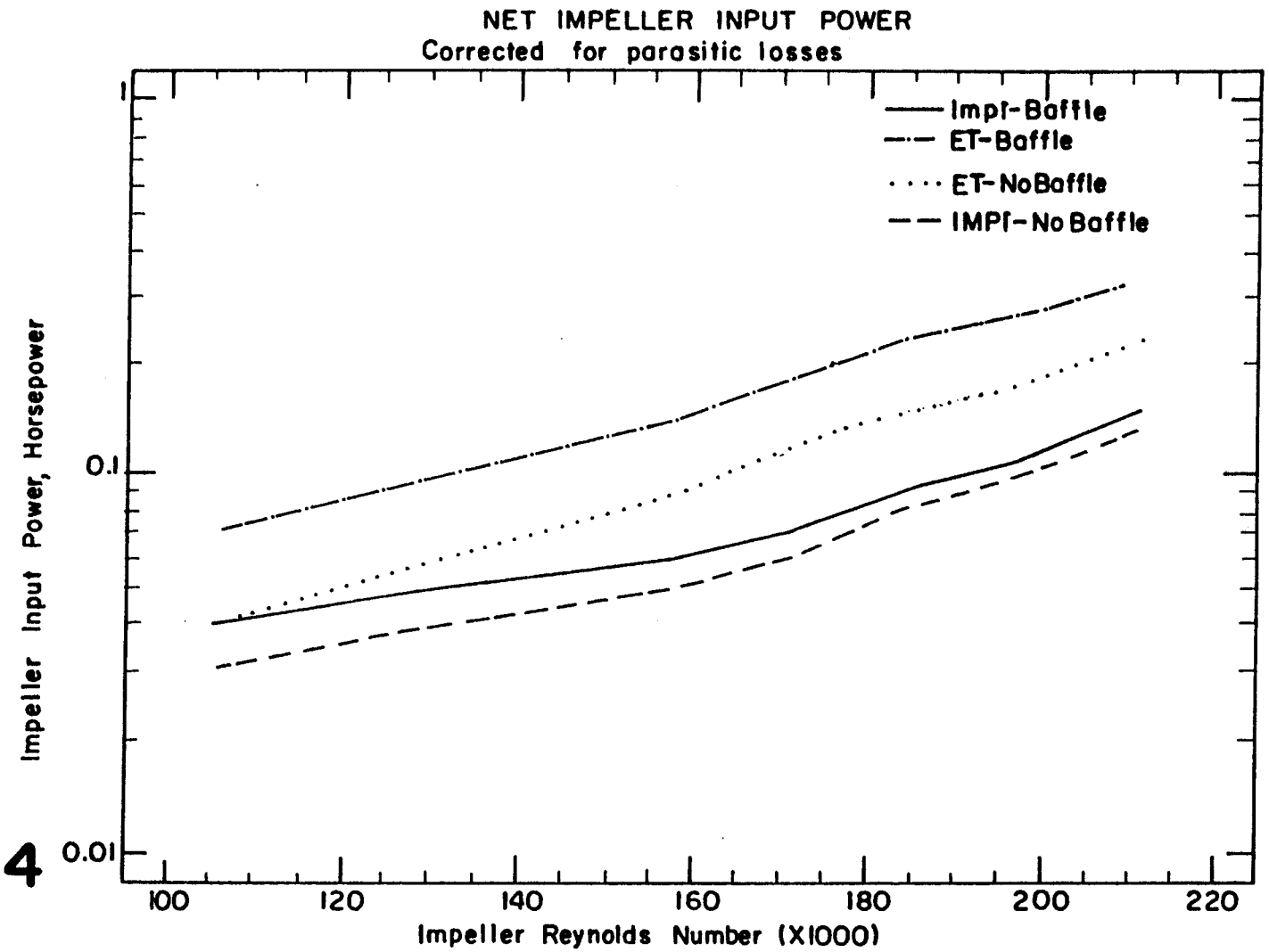
FIG. 14 is a graphical illustration of a comparison of net impeller input power of two impellers.

Net impeller input power as a function of impeller Reynolds number is graphically illustrated in FIG. 14. The effect of baffles can be clearly seen. Note that the use of Reynolds number for the abscissa generalizes impeller rotational speed to other cases involving different fluids and impeller diameters.

The present invention is not limited to the particular embodiments of the present invention herein illustrated and described, but changes and modifications may be made therein and thereto within the scope of the following claims.

We claim:

1. A method for treating a liquid with a gas comprising the steps of:
   a) containing the liquid in a vessel having an impeller mounted on a shaft for rotation about an upright axis, providing a predetermined number of radially projecting vanes on the impeller, and submerging the top and bottom faces of the impeller in the liquid;
   b) introducing a gas into the liquid below the surface of the liquid;
   c) intermixing the gas and the liquid by creating predominantly radial flow to maximize shear by rotating the impeller below the surface of the liquid; and
   d) suppressing downward flow along said upright axis to prevent the formation of a surface vortex in the liquid.

2. The method of treating a liquid with a gas according to claim 1 wherein the liquid comprises a molten metal selected from the group of steel, magnesium, copper, zinc, tin, lead, iron, and their alloys, nickel base super alloys, and cobalt based super alloys.

3. The method of treating a liquid with a gas according to claim 1 wherein the liquid comprises a liquid having aerobic bacterial.

4. The method of treating a liquid with a gas according to claim 1 wherein the liquid comprises a liquid having anaerobic bacteria.

5. The method of treating a liquid with a gas according to claim 1 wherein the liquid comprises a carbonation gas.

6. The method of treating a liquid with a gas according to claim 1 wherein the gas is introduced from an external gas source through a hollow impeller shaft having a gas outlet opening adjacent said impeller.

7. The method of treating a liquid with a gas according to claim 6 wherein the gas is introduced below the bottom face of the impeller.

8. A method of for treating a liquid with a gas according to claim 1 wherein a surface vortex is suppressed by positioning a baffle in the vessel below the surface of the fluid and extending it toward the impeller.

9. The method of treating a gas with a liquid according to claim 6 including the step of providing the leading surface of each vane with a projecting axial shroud.

10. The method of treating a liquid with a gas according to claim 9 wherein formation of a downward flow of liquid is retarded by controlling the rotational speed of the impeller.

11. The method for treating a liquid with a gas according to claim 9 wherein formation of a downward flow of liquid is retarded by controlling the rotational speed of the impeller and providing a hollow impeller shaft having an outlet opening, and an impeller head having a hub, positioning said impeller head on said shaft adjacent the outlet opening on the shaft to provide a first end surface of the hub adjacent said outlet opening and a second end surface of the hub remote from said outlet opening, providing a predetermined number of vanes fixed to and extending radially beyond said hub, sand increasing turbulence in the fluid upon rotation of said impeller head, by providing an axial groove in one of said end surfaces of the hub.

12. The method of treating a liquid with a gas according to claim 1 wherein the surface vortex is suppressed by locating the impeller asymmetrically within the vessel.

13. The method of treating a liquid with a gas according to claim 1 wherein the surface vortex is suppressed by providing an irregularly shaped vortex to contain the liquid.

14. The method of treating a liquid with a gas according to claim 1 wherein the surface vortex is suppressed by modifying the fluid flow field by providing more than one impeller stacked on the impeller shaft.

15. The method of treating a liquid with a gas according to claim 1 wherein the step of intermixing the gas and the liquid with the impeller comprises creating turbulence by rotating the impeller through the liquid to create a series of vortices behind the vanes to generate shear.

16. The method of treating a liquid with a gas according to claim 15 further comprising the step of increasing the turbulence created by the impeller by providing an axial bore in the impeller to increase the shear generated by the rotating impeller.

17. The method of treating a liquid with a gas according to claim 15 further comprising the step of increasing the turbulence created by the impeller by providing more than one impeller having an axial bore.

18. The method of treating a liquid with a gas according to claim 15 comprising the step of increasing the turbulence by finely dispersing the gas into the liquid with a gas injector remote from said impeller.

19. The method of treating a liquid with a gas according to claim 1 wherein the gas and liquid are intermixed by controlling the rotational speed of the impeller and providing a hollow impeller shaft having an outlet opening, and an impeller head having a hub, positioning said impeller head on said shaft adjacent the outlet opening on the shaft to provide a first end surface of the hub adjacent said outlet opening and a second end surface of the hub remote from said outlet opening, providing a predetermined number of vanes fixed to and extending radially beyond said hub, and increasing turbulence in the fluid upon rotation of said impeller head, by providing an axial groove in one of said end surfaces of the hub.

20. A method for treating a liquid with a gas comprising the steps of:

a) containing the liquid in vessel having an impeller mounted on a shaft for rotation about an upright axis, said impeller having a predetermined number of radially extending vanes, said vanes each having a leading and trailing surface, and submerging the top and bottom faces of the impeller in the liquid;
b) introducing a gas into the liquid below the surface of the liquid;
c) intermixing the gas and the liquid by creating predominantly radial flow to maximize shear by rotating the impeller below the surface of the liquid;
d) creating an upward flow of liquid along the upright axis by providing a canted leading surface on the vanes relative to the trailing surface which is operable to suppress downward flow upon rotating the impeller.

21. The method of treating a liquid with a gas according to claim 20 wherein the upward flow of liquid is controller to suppress the formation of a surface vortex in the liquid.

22. The method of treating a liquid according to claim 20 wherein an upward flow of liquid is created by controlling the rotational speed of the impeller and by providing an impeller head having a hub and a predetermined number of vanes fixed to and extending radially beyond said hub, said vanes being generally equally spaced about the outer perimeter of said hub, each vane having first and second end surfaces, and a leading surface and trailing surface, said leading surface being oblique relative to said trailing surface and to said end surfaces.

23. The method of treating a liquid according to claim 20 wherein an upward flow of liquid is created by controlling the rotational speed of the impeller and providing a hollow impeller shaft having an outlet opening, and an impeller head having a hub, positioning said impeller head on said shaft adjacent the outlet opening on the shaft to provide a first end surface of the hub adjacent said outlet opening and a second end surface of the hub remote from said outlet opening, providing a predetermined number of vanes fixed to and extending radially beyond said hub, and increasing turbulence in the fluid upon rotation of said impeller head, by providing an axial groove in one of said end surfaces of the hub.

24. The method of treating a liquid with a gas according to claim 20 further comprising the step of suppressing the formation of a surface vortex in the liquid.

25. The method of treating a liquid with a gas according to claim 24 wherein formation of a surface vortex is suppressed by positioning a baffle in the vessel below the surface of the fluid and extending it toward the impeller.

26. The method of treating a liquid with a gas according to claim 24 wherein formation of a surface vortex is suppressed by locating the impeller asymmetrically within the vessel.

27. The method of treating a liquid with a gas according to claim 24 wherein formation of a surface vortex is suppressed by providing an irregularly shaped vessel to contain the liquid.

28. The method of treating a liquid with a gas according to claim 20 wherein the step of intermixing the gas and the liquid with the impeller comprises creating turbulence by rotating the impeller through the liquid to create a series of vortices behind the vanes to generate shear.

29. The method of treating a liquid with a gas according to claim 28 further comprising the step of increasing the turbulence created by the impeller by providing an axial bore in the impeller thereby increasing the shear generated by the rotating impeller.

30. The method of treating a liquid with a gas according to claim 28 comprising the step of increasing the turbulence by finely dispersing the gas into the liquid with a gas injector remote from said impeller.

31. The method of treating a liquid according to claim 20 wherein the gas and liquid are intermixed by controlling the rotational speed of the impeller and by providing an impeller head having a hub and a predetermined number of vanes extending radially beyond said hub, each having a leading surface oblique relative to its trailing surface.

32. The method of treating a liquid with a gas according to claim 20 wherein the gas and liquid are intermixed by controlling the rotational speed of the impeller and providing a hollow impeller shaft having an outlet opening, and an impeller head having a hub, positioning said impeller head on said shaft adjacent the outlet opening on the shaft to provide a first end surface of the hub adjacent said outlet opening and a second end surface of the hub remote from said outlet opening, providing a predetermined number of vanes fixed to and extending radially beyond said hub, and increasing turbulence in the fluid upon rotation of said impeller head, by providing an axial groove in one of said end surfaces of the hub.

33. The method of treating a liquid with a gas according to claim 20 wherein the liquid comprises a molten metal selected from the group of steel, magnesium, copper, zinc, tin, lead, iron, and their alloys, nickel base super alloys, and cobalt based super alloys.

34. The method of treating a liquid with a gas according to claim 20 wherein the liquid comprises a liquid having aerobic bacteria into the vessel.

35. The method of treating a liquid with a gas according to claim 20 wherein the liquid comprises a liquid having anaerobic bacteria into the vessel.

36. The method of treating a liquid with a gas according to claim 20 wherein the gas comprises a carbonation gas.

37. The method of treating a liquid with a gas according to claim 20 wherein the gas is introduced form an external gas source through a hollow impeller shaft having a gas outlet opening adjacent said impeller.

38. The method of treating a liquid with a gas according to claim 20 wherein introducing the gas is effected below the bottom face of the impeller.

* * * * *

UNITED STATES PATENT AND TRADEMARK OFFICE

CERTIFICATE OF CORRECTION

PATENT NO. : 5,314,525

DATED : May 24, 1994

INVENTOR(S) : Charles E. Eckert and Nicholas G. Walker

It is certified that errors appear in the above-identified patent and that said Letters Patent is hereby corrected as shown below:

Column 9, line 14, "SCFJ" should be --SCFH--;

Column 10, line 34, "liquid" should be --gas--;

Column 10 (Claim 9, line 48), "claim 6" should be --claim 20--;

Column 10 (Claim 10, line 51), "claim 9" should be --claim 1--;

Column 10 (Claim 11, line 55), "claim 9" should be --claim 1--;

Column 11 (Claim 21, line 67), "controller" should be --controlled--.

Signed and Sealed this

Eleventh Day of July, 1995

*Attest:*

Bruce Lehman

BRUCE LEHMAN

*Attesting Officer*

*Commissioner of Patents and Trademarks*